US005902451A

United States Patent [19]

O'Mara et al.

[11] Patent Number: 5,902,451

[45] Date of Patent: May 11, 1999

[54] APPLICATOR FOR WALLBOARD JOINT COMPOUND

[75] Inventors: John E. O'Mara, Conway Springs; Robert E. O'Mara, Wichita, both of Kans.

[73] Assignee: Rimfire Management Corporation, Winfield, Kans.

[21] Appl. No.: 08/892,428

[22] Filed: Jul. 14, 1997

Related U.S. Application Data

[ 60] Provisional application No. 60/021,801, Jul. 15, 1996.

[51] Int. Cl.[6] ..... B32B 31/00

[52] U.S. Cl. ..... 156/579; 156/575

[58] Field of Search ..... 156/574, 575, 156/578, 579

[56] References Cited

U.S. PATENT DOCUMENTS

| | | | |
|---|---|---|---|
| 3,576,091 | 4/1971 | Shull, Jr. et al. | 52/309 |
| 3,707,427 | 12/1972 | Erickson | 156/575 |
| 4,208,239 | 6/1980 | Lass | 156/575 |
| 4,642,158 | 2/1987 | Steinel et al. | 156/497 |
| 4,652,331 | 3/1987 | Plasencia | 156/526 |
| 4,689,107 | 8/1987 | Entwistle | 156/465 |
| 4,775,442 | 10/1988 | Januska | 156/575 |
| 5,013,389 | 5/1991 | Retti | 156/575 X |
| 5,230,608 | 7/1993 | Januska | 417/44 |
| 5,242,495 | 9/1993 | Hammond et al. | 118/43 |
| 5,545,287 | 8/1996 | Carlson | 156/575 |

*Primary Examiner*—James Engel
*Attorney, Agent, or Firm*—James E. Bradley

[57] ABSTRACT

An applicator for applying joint compound or mud to wallboard has six embodiments with a head, a mud outlet and a mud hose. The applicator has a handle and a control valve for controlling the flow of mud. Each embodiment also has a screed on the head above the mud outlet which extends beyond the end of the head. The screed smoothes down the mud applied to the wall and wipes away any excess mud. The first embodiment has a fan-shaped head with baffles to define multiple flow ports. The second and third embodiments have a rectangular head and a pair of retractable corner stops which align the mud outlets flush with the corners of drywall sections. The third embodiment adds a dispersion mechanism for varying the width of the outlet. The fourth embodiment of the applicator has a wedge-shaped head and a V-shaped screed with flow ports in the sidewalls that are designed to apply mud to right-angled corners. The control valve of the final embodiment has a cylindrical core with a slot which selectively aligns with a slot in the mud chamber. The control valve is operated by a spring-biased lever which contacts the wall. The lever has a pair of arms and a wheel on each arm. The arms extend from an outer edge of the control valve past the mud outlet to automatically open flow when the head is pressed against the wall.

23 Claims, 9 Drawing Sheets

APPLICATOR FOR WALLBOARD JOINT COMPOUND

This application is a continuation of provisional application No. 60/021,801.

TECHNICAL FIELD

This invention relates in general to drywall tools and in particular to a drywall mud applicator.

BACKGROUND ART

Some interior walls are fabricated from sheets of wallboard or drywall. During installation, the wallboard sheets are fastened or nailed to frame studs. Many of the nails will form small recesses or indentations in the surfaces of the wallboard sheets. These surfaces must be smooth in order for the wall to have a seamless appearance after texture or other wall treatments are applied. The process of smoothing the wall surface, commonly known as "floating," is performed by applying a thin layer of joint compound or "mud" to the wall to fill in the indentations. The mud is screeded or smoothed before it hardens to make the wall appear over its entire surface. In the prior art, this work is typically accomplished by laborers who apply the mud by hand. Screeding is typically performed by running a drywall knife over the mud applications. This process is time consuming and often results in uneven or inconsistent results.

DISCLOSURE OF INVENTION

The invention comprises an applicator for dispensing and applying joint compound or mud to wallboard. The applicator is connected to a mud hose which provides a continuous source of mud. The applicator has a hollow cylindrical handle with a control valve for controlling the flow of mud from the hose into the applicator. The control valve has a lever for actuating the control valve.

In a first embodiment, the applicator forms a large fan-shaped head at the end of the handle. The distal end of the head has a mud outlet formed by an opening along the width of the head for dispersing mud from the applicator. The outlet has several baffles which spread the mud flow evenly across the entire width of the outlet. The head also has a pair of shoe slides mounted, one on each side of the outlet, for preventing wear to the head. A screed is to an upper surface of the head above the mud outlet and extends beyond the end of the head. The screed smoothes down the mud applied to the wall and wipes away any excess mud. As mud is dispersed, the user moves the applicator down the wall as he applies pressure against the wall, thereby forcing the screed against the mud already dispersed to smooth the mud and wipe away the excess.

The second and third embodiments of the invention are similar to each other. Like the first embodiment, these versions of the applicator comprise a head, a mud hose, a control valve, a handle, shoe slides and a screed. The heads of these applicators are generally rectangular-shaped with hollow chambers and mud outlets. These embodiments also comprise a pair of retractable corner stops, one on each side of the head. The corner stops align the mud outlets flush with the corners of drywall sections. The third embodiment adds a dispersion mechanism for varying the width of the dispersion of mud. The dispersion mechanism has a spring-biased plunger which may be set at a variety of widths.

The fourth embodiment of the applicator is designed to apply mud to right-angled corners. It has a head, a mud hose, a control valve, a handle, and a screed. The heads of this applicator is wedge-shaped with a hollow chamber and a plurality of mud outlet holes. The screed is V-shaped and generally aligns with and extends from an upper surface of the head.

The final embodiment is most similar to the second embodiment. It has a box-shaped head, a mud hose, a control valve, a handle, a screed, corner stops and shoe slides. The control valve is mounted in the applicator and has a transverse, rotatably-mounted cylindrical core located within a bore in the head. The core has a longitudinal slot which reversibly aligns with the mud chamber to release mud into the mud chamber. The control valve is operated by a spring-biased flow lever which contacts the wall. The flow lever has a pair of arms and a wheel on one end of each of the arms. The arms extend from an outer edge of the control valve past the mud outlet.

BEST MODE FOR CARRYING OUT THE INVENTION

Figure 1:
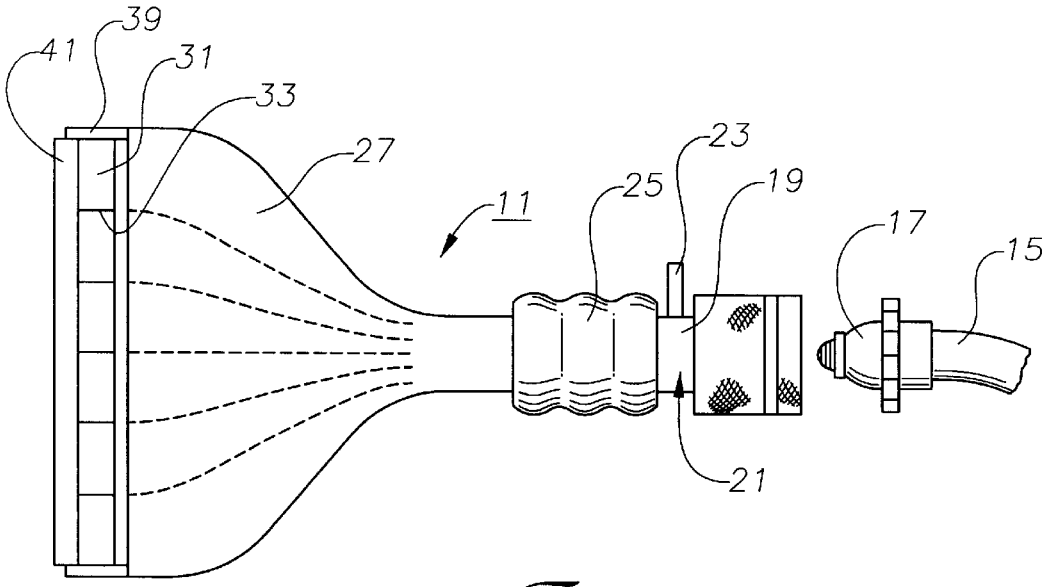
FIG. 1 is a front view of a first embodiment of a wallboard joint compound applicator constructed in accordance with the invention.
Figure 2:
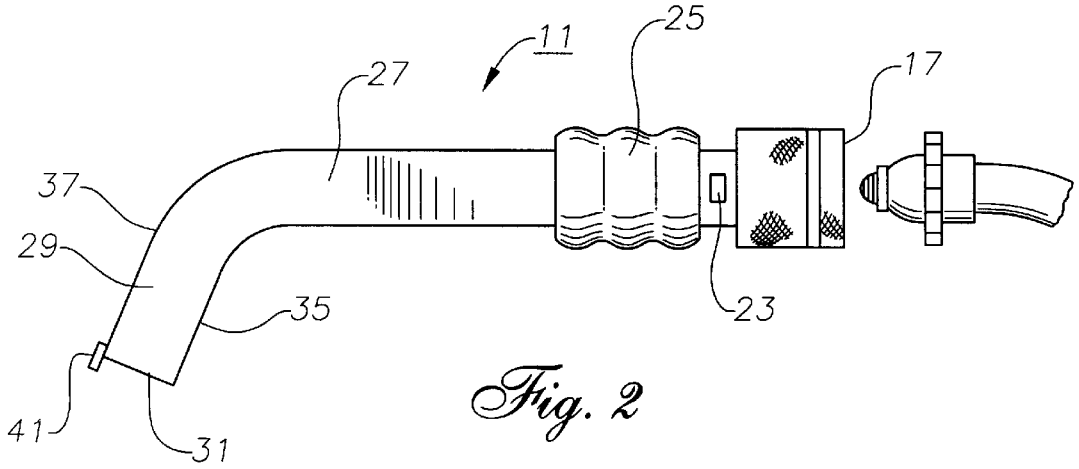
FIG. 2 is a side view of the applicator of FIG. 1.

FIGS. 1 and 2 show a first applicator 11 embodiment of the present invention for dispensing and applying joint compound (mud) to wallboard (drywall). Applicator 11 is connected at one end to a mud hose 15 for providing a continuous source of mud or texture (not shown), which is a plaster-like compound. Mud is powered through hose 15 by a pump (not shown) at the opposite end of hose 15. Hose 15 and applicator 11 are connected with a conventional connector 17 known to those skilled in the art of connectors.

Still referring to FIGS. 1 and 2, a portion of applicator 11 nearest to hose 15 forms a hollow cylindrical handle 19. A control valve 21 is mounted to handle 19 directly adjacent to connector 17 for controlling the flow of mud from hose 15 into applicator 11. Control valve 21 is a conventional valve known to those skilled in the art of valves. Control valve 21 has a lever 23 extending over a rubber or plastic grip 25 on handle 19. A user holds applicator 11 on grip 25 and squeezes lever 23 to close control valve 21 and stop the flow of mud or releases lever 23 to open control valve 21 and restart the flow of mud.

FIG. 1 shows that applicator 11 forms a fanned portion 27 at the end of handle 19 opposite connector 17 a short distance beyond grip 25. Fanned portion 27 has a significantly larger width than the cylindrical portion of handle 19, but the thickness of fanned portion 27 remains approximately equal to the diameter of handle 19. The free end 29 of fanned portion 27 opposite handle 19 is bent at approximately a forty five degree angle relative to handle 19 and about an axis parallel to the width of fanned portion 27, as shown in FIG. 2. FIG. 1 shows that free end 29 has a mud exit 31 formed by an opening along the width of fanned portion 27 for dispersing mud from applicator 11.

Fanned portion 27 of applicator 11 is hollow for allowing mud to flow from handle 19 and out mud exit 31. However, FIG. 1 illustrates that several supply webs 33 are inside fanned portion 27 for dividing applicator 11 and dispersing the mud evenly across the entire width of fanned portion 27 at mud exit 31. Supply webs 33 are solid walls connecting the lower wall 35 of applicator 11 to the upper wall 37 of applicator 11 and are at approximately evenly spaced intervals across the width of fanned portion 27. Each web 33 begins in the area where fanned portion 27 and handle 19 join and ends at mud exit 31.

Still referring to FIG. 1, mud exit 31 forms a rectangular opening at the free end 29 of applicator 11. Two metal or plastic shoe slides 39 are mounted to free end 29, one on each side of the rectangle formed by mud exit 31. Shoe slides 39 are small, solid rectangular pieces of metal or plastic that contact the wall (not shown) to which mud is being applied and prevent wear to the free end 29 of applicator 11. When repetitive use of applicator 11 wears down shoe slides 39 such that the free end 29 of applicator 11 begins to contact the wall, new shoe slides 39 are mounted on the free end 29 to replace the old ones, thus extending the useful life of applicator 11.

As shown in FIGS. 1 and 2, a rubber or metal screed 41 is connected to the upper wall 37 of applicator 11 above mud exit 31 and extends beyond the free end 29 of applicator 11. Screed 41 is for smoothing down the mud applied to the wall by applicator 11 and for wiping away any excess mud. As mud is dispersed from mud exit 31, the user moves applicator 11 down the wall as he applies pressure to applicator 11 against the wall, thereby forcing screed 41 against the mud already dispersed to smooth the mud and wipe away the excess.

In operation, the user opens control valve 21 by gripping lever 23 to produce the desired flow of mud and pressures the free end 29 of applicator 11 against the wall to which the mud is to be applied. The mud flows through applicator 11 and disperses out of mud exit 31 evenly because of supply webs 33. Finally, the pressure applied to applicator 11 as it is moved down the wall causes screed 41 to smooth the mud on the wall and to wipe away any excess mud dispersed.

Figure 4:
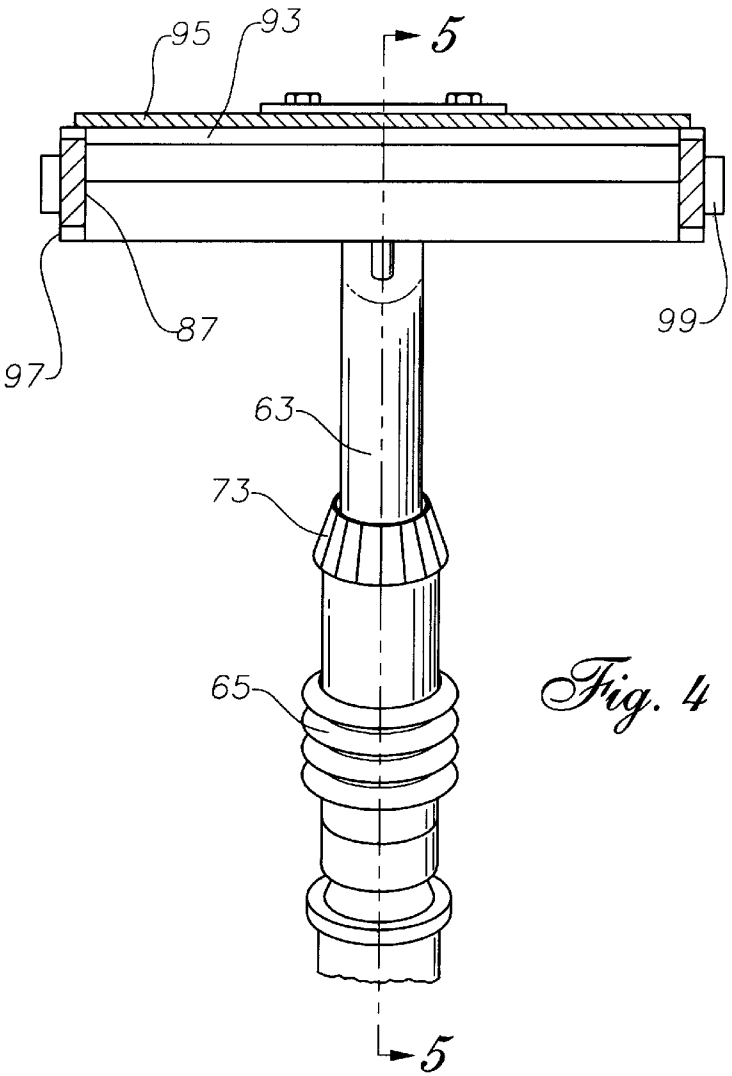
FIG. 4 is a front view of the applicator of FIG. 3.
Figure 3:
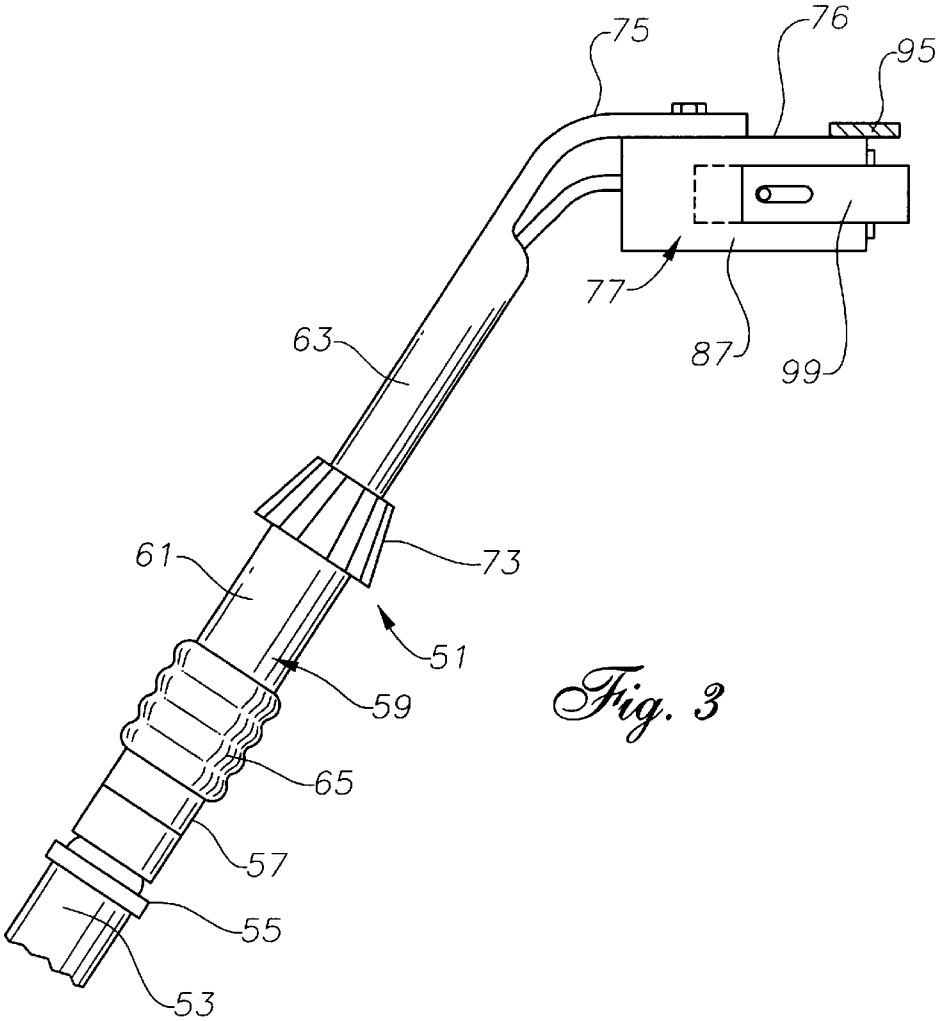
FIG. 3 is a side view of a second embodiment of an applicator.
Figure 5:
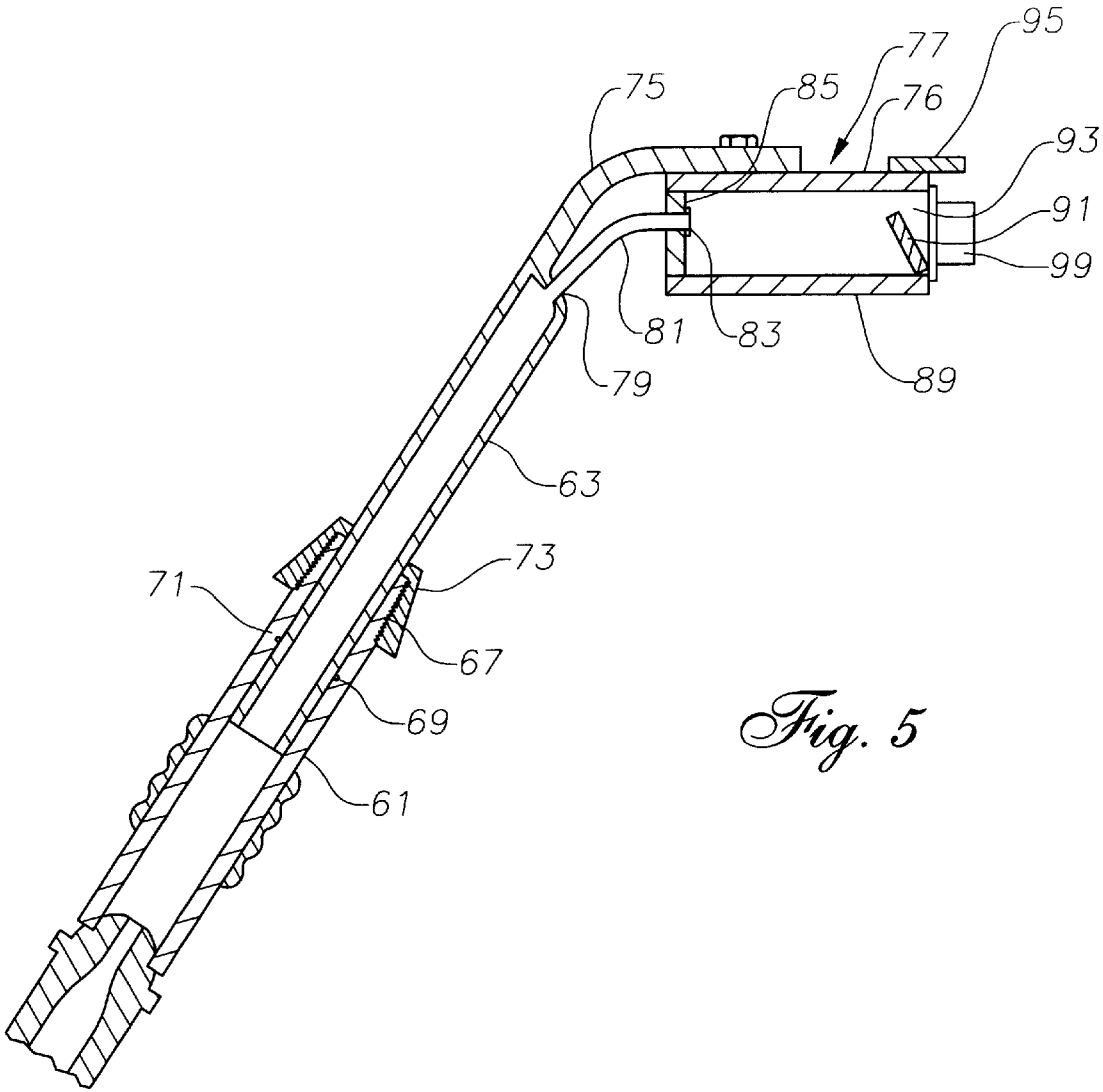
FIG. 5 is a side sectional view of the applicator of FIG. 4, taken along line V—V.

FIGS. 3–5 show a second embodiment of the present invention for dispensing and applying joint compound (mud) to wallboard (drywall). Applicator 51 is connected to a continuous source mud hose 53 with a connector 55 similar to the fan-type applicator embodiment 11. In this embodiment, control valve 57 is identical to control valve 21 of the first embodiment but is located on mud hose 53 instead of applicator tool 51. Control valve 57 operates identically to control valve 21 of the first embodiment 11 to control the flow of mud into applicator 51. The advantage of mounting control valve 57 on mud hose 53 is that various applicator tools can be interchangeably connected to mud hose 53 and only one control valve 57 is required rather than building a control valve 57 into each separate tool.

Still referring to FIGS. 3–5, applicator 51 has a handle portion 59 comprising two pieces, a lower handle 61 and an extension arm 63. Lower handle 61 is cylindrically shaped and hollow and is attached to connector 55 at one end. A rubber or plastic grip 65 is located on the middle portion of lower handle 61 for holding applicator 51. As shown in FIG. 5, the end of lower handle 61 opposite connector 55 has threads 67 around its outer surface which angle toward the cylindrical axis of lower handle 61 as they approach its edge. Finally, lower handle 61 has a circumferential groove 69 around its inner surface near the end of lower handle 61 with threads 67.

As shown in FIG. 5, one end of extension arm 63 of handle 59 is cylindrically shaped and hollow with an outer diameter slightly less than the inner diameter of lower handle 61. This end of extension arm 63 has a circular opening and is slidably fitted into the end of lower handle 61 with threads 67 such that the cylindrical axes of both pieces align with each other. An O-ring 71 is fitted in the circumferential groove 69 in lower handle 61 and makes contact with the inner surface of lower handle 61 and the outer surface of extension arm 63. A tightener ring 73 threaded on its inner surface fits over the outside of both lower handle 61 and extension arm 63. The threads of tightener ring 73 interact with those of lower handle 61 such that screwing tightener ring 73 farther down lower handle 61 radially compresses lower handle 61 onto arm extension 63. This compression creates a seal between lower handle 61, O-ring 71, and arm extension 63. This seal prevents mud from leaking out of the cylindrical interior spaces of lower handle 61 and extension arm 63, only allowing mud flow out of one part of handle 59 and into another.

Referring to FIGS. 3 and 5, the end of extension arm 63 opposite lower handle 61 has a bracket portion 75 that bends at approximately forty five degrees relative to the cylindrical axes of the two parts of handle 59. Bracket portion 75 is secured to the top wall 76 of mud dispenser 77 by a pair of bolts or other suitable fastener. As shown in FIG. 5, the open interior space created by the cylindrical portion of arm extension 63 is blocked off by a closed surface 79 just before bracket portion 75 begins on arm extension 63. A mud tube 81 is secured to arm extension 63 and extends from the open interior space of arm extension 63, through closed surface 79, out of arm extension 63, and into mud dispenser 77. Because of closed surface 79 and the seal created by tightener ring 73 and O-ring 71, mud flowing into handle 59 can only pass out of handle 59 through mud tube 81.

Still referring to FIG. 5, the end of mud tube 81 in mud dispenser 77 passes through an inlet port 83 in the back wall 85 of mud dispenser 77 and is secured in place. Mud dispenser 77 comprises generally a rectangular shaped box formed by back wall 85, top wall 76, bottom wall 89, and two side walls 87. The front face of mud dispenser 77 has an angled front wall 91 that extends upward from the front edge of bottom wall 89, but does not fully extend to top wall 76. Instead, front wall 91 angles inward toward back wall 85 at an angle, leaving an opening near the top of the front side of mud dispenser 77 as a mud exit 93. The angle of inclination of front wall 91 with bottom wall 89 is adjustable between thirty and forty five degrees.

As shown in FIGS. 3–5, a rubber or metal screed 95 is attached to the top wall 76 of mud dispenser 77 above mud exit 93 and extends beyond the front edge of top wall 76. Screed 95 is for smoothing down the mud applied to a section of drywall (not shown) by applicator 51 and for wiping away any excess mud. Just as with the first embodiment of the present invention, mud is dispersed from mud exit 93 as the user moves applicator 51 down the drywall and applies pressure to applicator 51 against the wall. The applied pressure forces screed 95 against the mud already dispersed to smooth the mud and wipe away the excess. Also like the first embodiment, two metal or plastic shoe slides 97 are mounted to the mud dispenser 77, one on the front edge of each side wall 87. Shoe slides 97 contact the drywall to which mud is being applied and prevent wear to the walls of mud dispenser 77.

Finally, FIGS. 3–5 illustrate two corner stops 99, one connected to the outside of each side wall 87 of mud dispenser 77. Corner stops 99 are rigid blocks of material for aligning mud exit 93 flush with the corners of drywall sections. Each corner stop 99 is lockable into a corner position (solid lines) where part of corner stop 99 extends beyond the front edge of side wall 87 or a flat wall position (dotted lines) where corner stop 99 does not extend beyond the front edge of side wall 87. In the corner position, applicator 51 is placed against the section of drywall such that corner stop 99 is located beyond the corner and then applicator 51 is slid across the drywall until corner stop 99 abuts the corner. In this position, corner stop 99 prevents excess mud from being spread beyond the corner of the drywall section. In the flat wall position (dotted lines in FIG. 3), applicator 51 can abut a flat section of drywall without corner stop 99 contacting the drywall. Corner stops 99 slide rearward to the flat wall position.

In operation, the user can vary the length of the handle portion 59 of applicator 51 by loosening tightener ring 73, sliding extension arm 63 farther into or out of lower handle 61, and retightening tightener ring 73. Once this adjustment is finished, mud is forced through mud hose 53 and into applicator 51 by a pump when control valve 57 on mud hose 53 is opened. The mud then flows through lower handle 61 and into extension arm 63, where it is forced into mud tube 81 and then into mud dispenser 77. A reservoir of mud is formed inside mud dispenser 77. Once enough mud has accumulated in mud dispenser 77 to reach a level above the upper edge of front wall 91, the mud is spread evenly across the entire width of mud dispenser 77 and is therefore applied evenly out of mud exit 93. Finally, pressure applied to applicator 51 as it is moved down a section of drywall causes screed 95 to smooth the mud applied to the drywall and to wipe away any excess mud. Furthermore, the angle of inclination of front wall 91 allows the user to vary the amount of mud dispersed by varying the height of mud exit 93.

FIGS. 6–10 illustrate a third embodiment of the present invention that combines elements of the fan-type embodiment with elements of the box-type embodiment, and adds a mechanism for varying the width of the dispersion of mud. Applicator 111 is connected at one end to a mud hose 115 for providing a continuous source of mud (not shown). Mud is powered through hose 115 by a pump (not shown) at the opposite end of hose 115. Hose 115 and applicator 111 are connected with a conventional connector 117 known to those skilled in the art of connectors.

Figure 9:
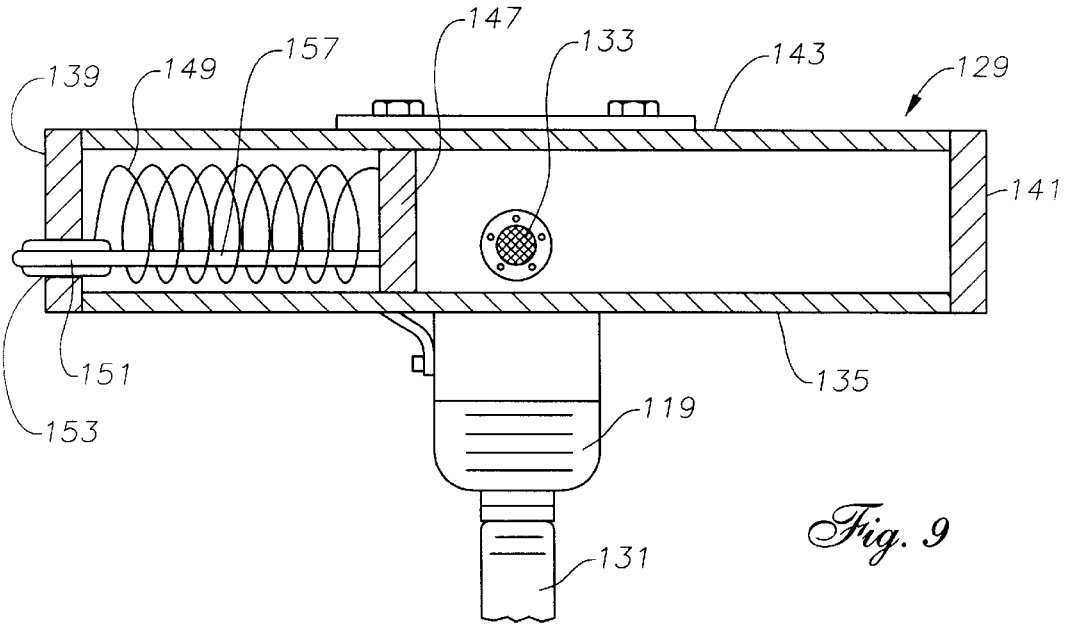
FIG. 9 is a side sectional view of the applicator of FIG. 6, taken along line IX—IX.

FIG. 9 shows that applicator 111 has a portion nearest to hose 115 that forms a handle 119. Handle 119 contains a cylindrical interior space throughout its length for transferring mud from hose 115. A control valve 121 (FIG. 10) is mounted to handle 119 directly adjacent to connector 117 for controlling the flow of mud from hose 115 into handle 119. Control valve 121 is a conventional valve known to those skilled in the art of valves. Control valve 121 has a valve lever 123 extending over handle 119. A user holds applicator 111 and squeezes valve lever 123 to close control valve 121 and stop the flow of mud or releases valve lever 123 to open control valve 121 and restart the flow of mud.

Figure 6:
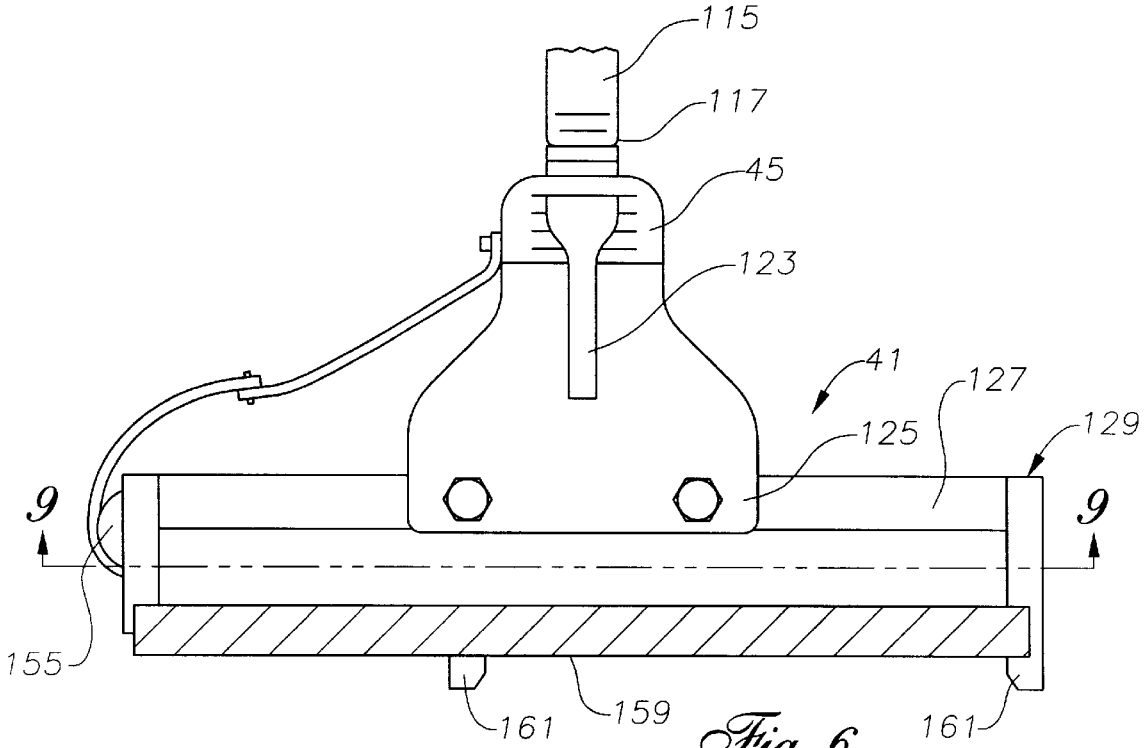
FIG. 6 is a top view of a third embodiment of an applicator.
Figure 7:
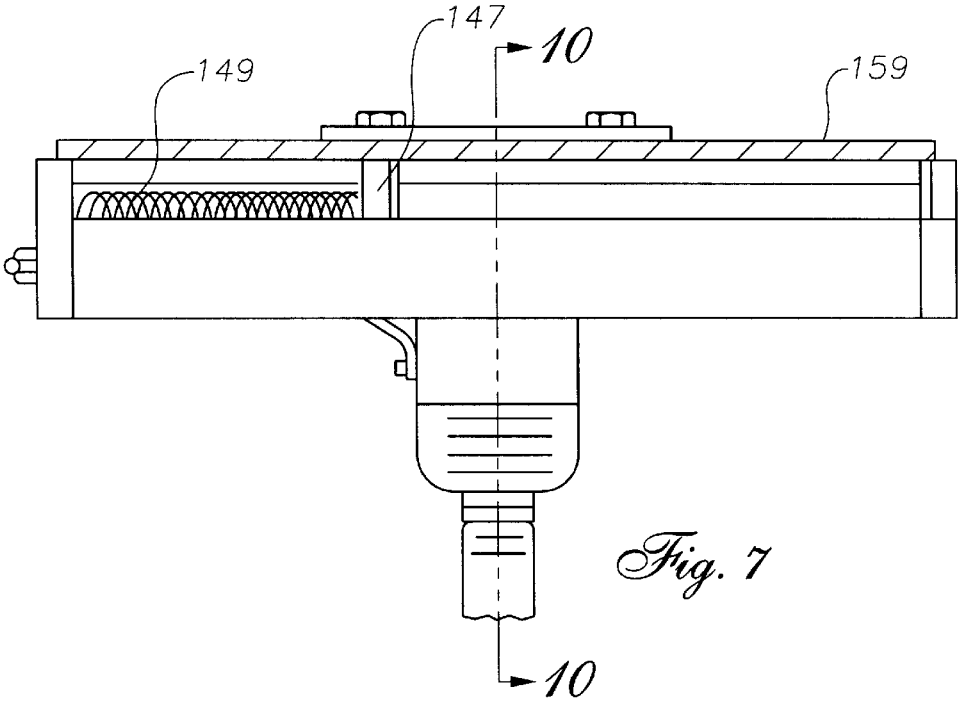
FIG. 7 is a front view of the applicator of FIG. 6.

Referring to FIG. 6, the end of handle 119 opposite connector 117 has a bracket portion 125 that bends at approximately forty five degrees relative to the cylindrical axis of the interior space of handle 119. Bracket portion 125 is secured to the top wall 127 of mud dispenser 129 by a pair of bolts or other suitable fastener. As shown in FIG. 9, one end of a mud tube 131 is secured to the cylindrical interior space of handle 119 and the other end passes through an inlet port 133 (seen in FIG. 10) in the back wall 135 of mud dispenser 129 and is secured.

Figure 10:
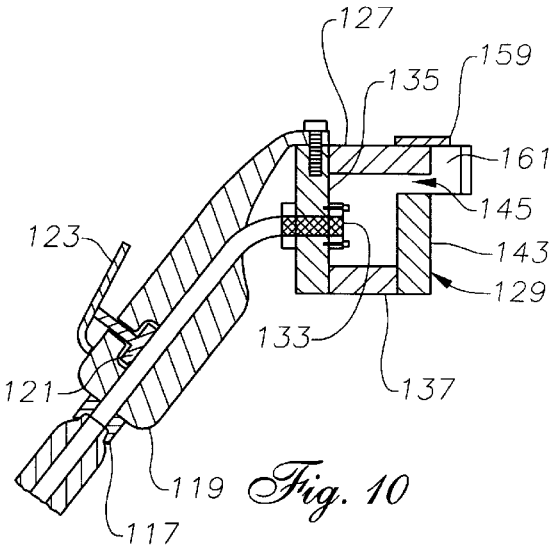
FIG. 10 is a front sectional view of the applicator of FIG. 7, taken along line X—X.

FIGS. 6–10 show that mud dispenser 129 comprises generally a rectangular shaped box formed by back wall 135, top wall 127, bottom wall 137, and two side walls 139, 141. Referring to FIG. 10, a front wall 143 also extends vertically upward from the front edge of bottom wall 137, but does not fully extend up to top wall 127. Instead, front wall 143 extends roughly three quarters of the distance to top wall 127, leaving an opening near the top of the front side of mud dispenser 129 as a mud exit 145.

As illustrated in FIG. 10, a plunger or piston 147 is located inside the interior space created by mud dispenser 129 and oriented parallel to side walls 139, 141. Plunger 147 is only slightly smaller than this interior space such that it fits snugly within the space. Ideally, plunger 147 does not allow mud located in one portion of this interior space to enter the other portion of this interior space by passing between the edge of plunger 147 and an inner surface of mud dispenser 129.

Also shown in FIG. 10 is a coil spring 149 located between plunger 147 and side wall 139. At a rest position, coil spring 149 forces plunger 147 into contact with side wall 141. As illustrated in FIG. 9, a pulley 151 is rotatably attached to side wall 139 in a rectangular hole 153 in side wall 139. An axis of rotation of pulley 151 passes through side wall 139 from its bottom edge to its top edge. Rectangular hole 153 has a width slightly larger than the diameter of pulley 151 and a height slightly larger than the thickness of pulley 151. As shown in FIG. 6, a plunger adjustment lever 155 is connected at its lower end to the side of handle 119 closest to side wall 139. The other end of plunger adjustment lever 155 extends at an angle away from handle 119 and toward side wall 139. A cable 157 is fastened at one end to the end of plunger adjustment lever 155 extending toward side wall 139. A central portion of cable 157 is seated on pulley 151 which guides cable 157 through rectangular hole 153 in side wall 139. FIG. 10 shows that the opposite end of cable 157 passes through the center of coil spring 149 and is fastened to the side of plunger 147 facing side wall 139.

Figure 8:
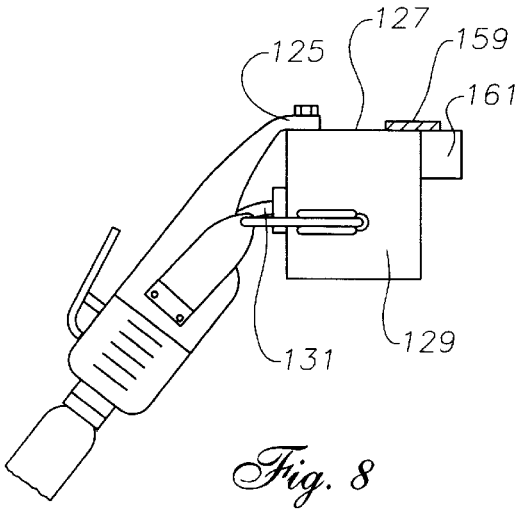
FIG. 8 is a side view of the applicator of FIG. 6.

Referring to FIGS. 6, 8, and 9, a rubber or metal screed 159 is attached to the top wall 127 of mud dispenser 129 above mud exit 145 and extends beyond the front edge of top wall 127. Screed 159 is for smoothing down the mud applied to a section of drywall (not shown) by applicator 111 and for wiping away any excess mud. Screed 159 operates identically to the screeds 41, 95 of the first two embodiments already described.

FIGS. 6–9 illustrate two corner stops or corner bead guides 161, one extending from the front edge of plunger 147 and another from the front edge of side wall 141. Each corner stop 161 extends a short distance beyond front wall 143. The bottom edge of each corner stop 161 abuts the top edge of front wall 143 and the top edge of each corner stop abuts the bottom edge of screed 159. In other words, each corner stop 161 has a height equal to the height of mud exit 145 plus the thickness of top wall 127.

In operation, this embodiment is designed for applying mud to narrow sections of drywall such as doorway openings, end walls, and columns. The user closes control valve 121 by squeezing valve lever 123 and opens plunger 147 to its maximum width position by squeezing plunger adjustment lever 155. Applicator 111 is then oriented such that front wall 143 abuts the drywall to which mud is to be applied and the two corner stops 161 are located beyond opposite corners of the drywall. User then releases plunger adjustment lever 155 and coil spring 149 forces plunger 147 toward side wall 141 until the corner stop 161 on each side wall 139, 141 abuts opposite corners of the drywall, thereby adjusting the width of the mud exit 145 of mud dispenser 129 to the width of the drywall and aligning the two.

After the width of mud 145 has been adjusted, user releases valve lever 123 and control valve 121 opens, allowing mud to be forced by a pump through mud hose 115 and into applicator 111. The mud then flows through handle 119 and is forced into mud tube 131 and then into mud dispenser 129. A reservoir of mud is formed inside mud dispenser 129. Once enough mud has accumulated in mud dispenser 129 to reach a level above the upper edge of front wall 143, the mud will spread evenly and be applied out of the width of mud exit 145 between plunger 147 and side wall 141. Finally, pressure applied to applicator 111 as it is moved down the section of drywall causes screed 159 to smooth the mud applied to the drywall and to wipe away any excess mud.

Figure 11:
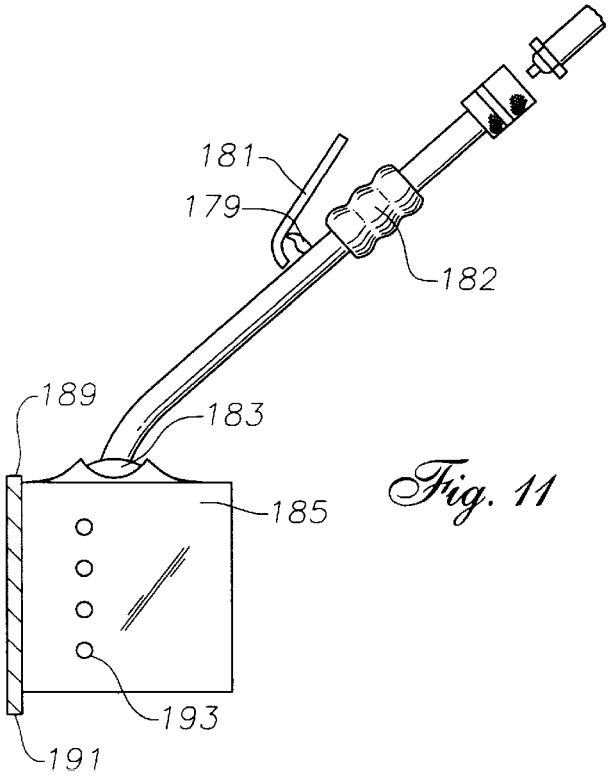
FIG. 11 is a side view of a fourth embodiment of an applicator.
Figure 12:
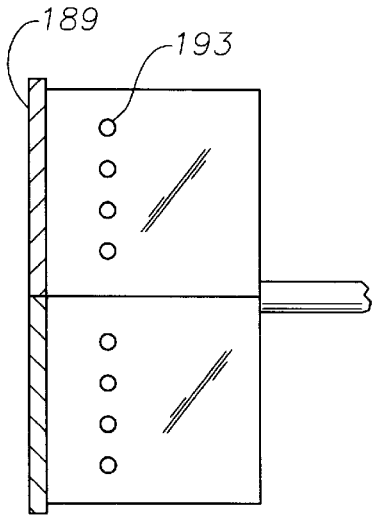
FIG. 12 is a partial front view of the applicator of FIG. 11.
Figure 13:
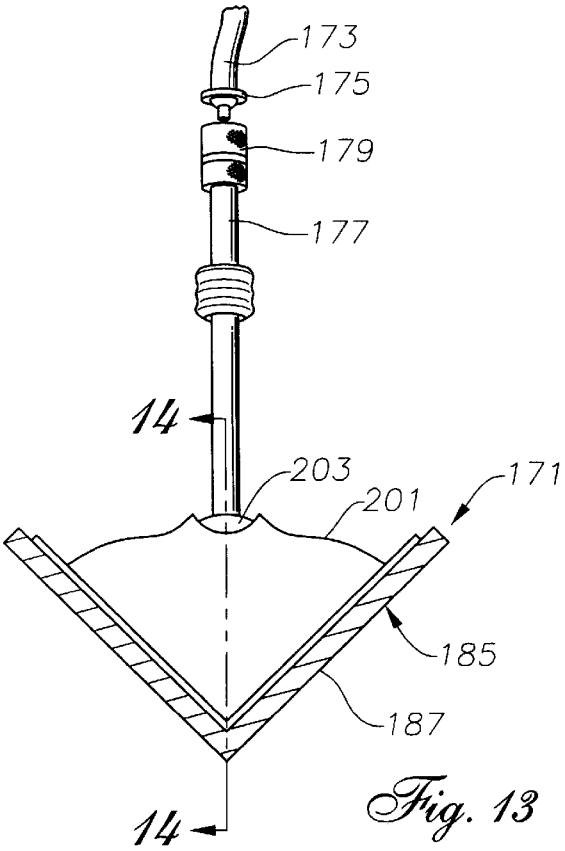
FIG. 13 is a top view of the applicator of FIG. 11.

FIGS. 11–14 illustrate a fourth embodiment of the present invention for dispensing and applying mud to drywall in right angle corners. As shown in FIGS. 11 and 13, an applicator 171 is connected to a mud hose 173 with a conventional connector 175 and a continuous source of mud is forced by a pump (not shown) through mud hose 173 into applicator 171. Also, applicator 171 has a hollow cylindrical handle 177 with a control valve 179 known to those skilled in the art. A valve lever 181 extends from control valve 179 over a grip 182 secured to handle 177. Squeezing valve lever 181 to handle 177 closes control valve 179, and releasing valve lever 181 opens control valve 179.

Figure 14:
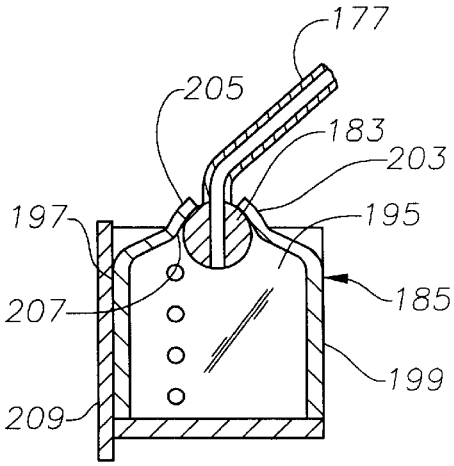
FIG. 14 is a partial side sectional view of the applicator of FIG. 13, taken along line XIV—XIV.

Still referring to FIG. 11, the end of handle 177 opposite connector 175 bends to an angle approximately forty five degrees relative to the axis of handle 177. FIG. 14 shows that this end of handle 177 terminates in a spherical ball joint 183 with a hollow cylinder continuing from the body of handle 177 through the center and out the opposite side of ball joint 183.

As shown in FIG. 13, handle 177 is attached to a mud dispenser 185 with two applicator faces 187 angled at approximately ninety degrees relative to each other. Mud dispenser 185 also has a top edge 189 and a bottom edge 191. FIG. 12 shows that each applicator face 187 has multiple mud apertures 193 for dispensing mud that are aligned on applicator face 187 parallel to top edge 189.

FIGS. 13 and 14 illustrate a mud reservoir 195 formed within the ninety degree angle created by applicator faces 187. Mud reservoir 195 has a top wall 197 aligned with the top edge 189 of applicator faces 187, a bottom wall 199 aligned with the bottom edge 191 of applicator faces 187, and applicator faces 187 enclose the front of mud reservoir 195. Mud reservoir 195 also has a back wall 201 that encloses mud reservoir 195 such that all of the mud apertures 193 in applicator faces 187 are included in the enclosed volume. In addition, the back wall 201 of mud reservoir 195 has a ball hinge 203 for accepting the ball joint 183 of handle 177. Ball hinge 203 is integrally formed in a central portion of back wall 201 and has a partial spherical shape 205 extending outward from the enclosed volume created by mud reservoir 195. A circular aperture 207 is formed radially through the center of this spherical shape with a diameter greater than the diameter of handle 177, but smaller than the diameter of ball joint 183. Handle 177 extends through the aperture 207 of ball hinge 203 and ball joint 183 at the end of handle 177 seats in the partial spherical shape 205 of ball hinge 203. As a result, mud dispenser 185 is free to rotate in any direction up to almost one hundred eighty degrees relative to handle 177.

FIGS. 11–14 show that a rubber or metal screed 209 is attached to the top edge 189 of applicator faces 187 above mud apertures 193 and extends beyond the front edge of applicator faces 187.

In operation, mud is forced through mud hose 173 and into applicator 171 by a pump when control valve 179 is opened by releasing valve lever 181. The mud then flows through handle 177, through ball joint 183, and into mud reservoir 195. Once enough mud has accumulated in mud reservoir 195 to reach a level above mud apertures 193, the mud will be spread evenly out of mud apertures 193. Finally, pressure is applied to applicator 171 as it is moved down the right angle corner section of drywall such that screed 209 smoothes the mud applied to the drywall and wipes away any excess mud.

Figure 15:
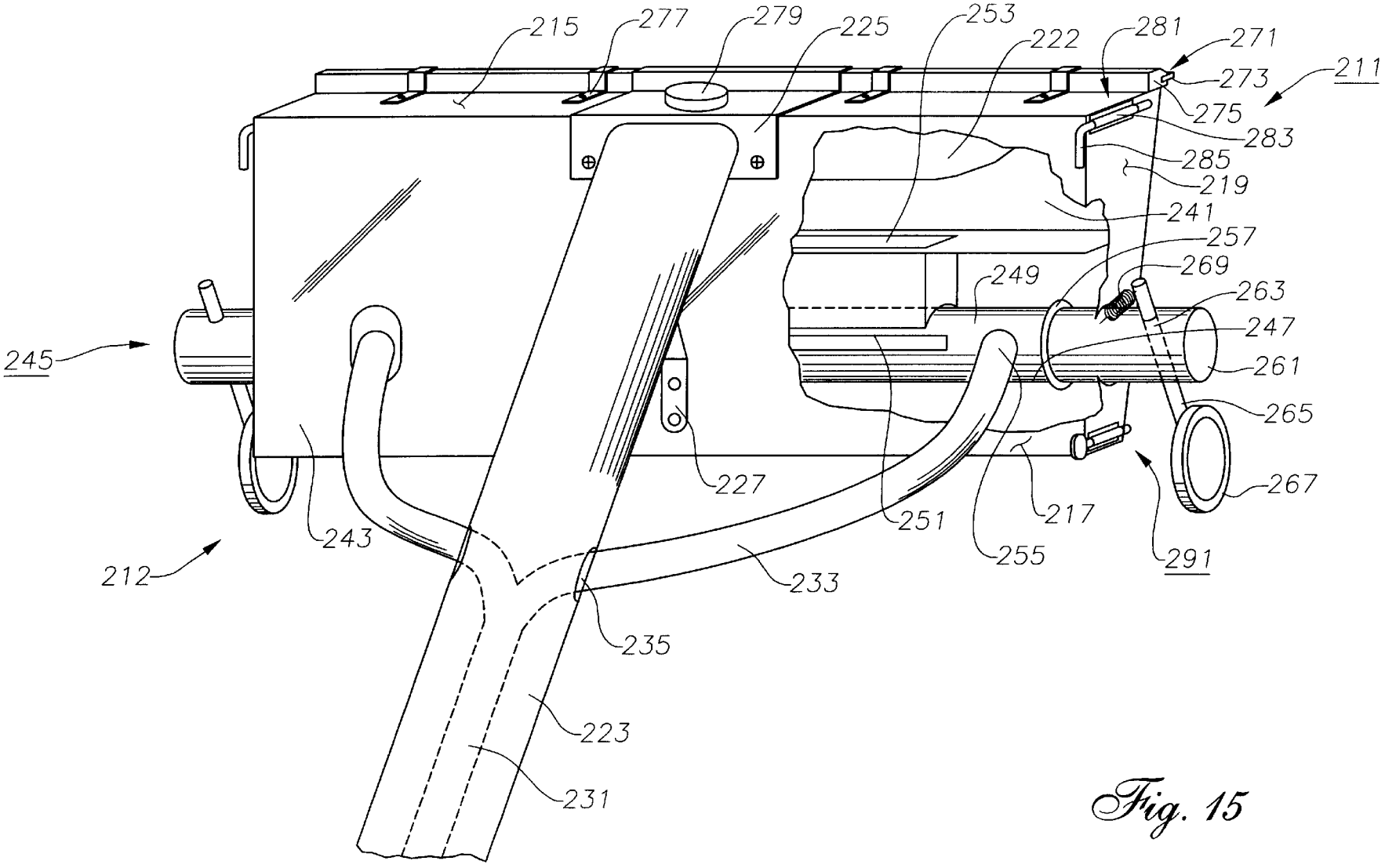
FIG. 15 is a rear isometric view of a fifth embodiment of the applicator.
Figure 16:
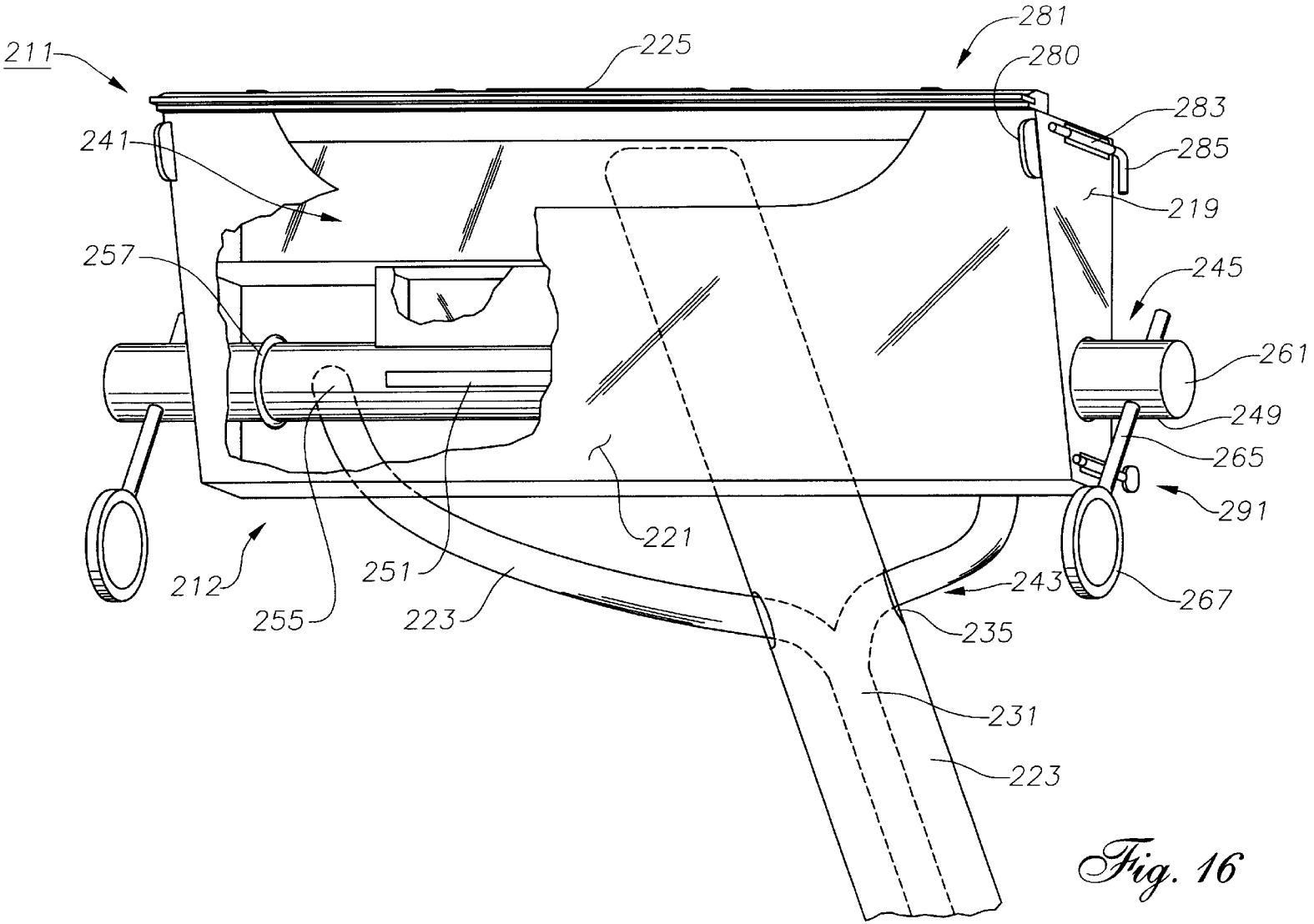
FIG. 16 is a front isometric view of the applicator of FIG. 15.
Figure 17:
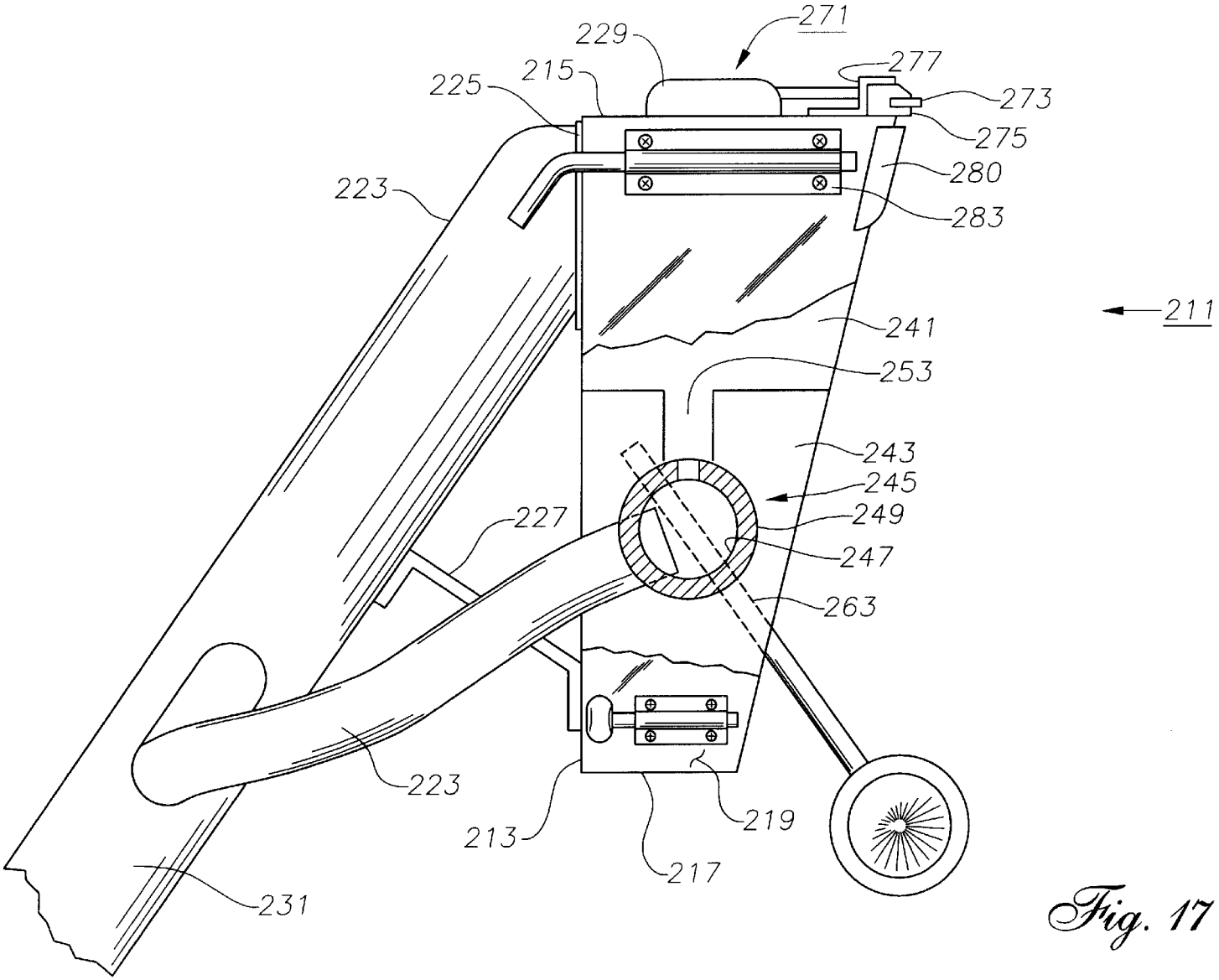
FIG. 17 is a side sectional view of the applicator of FIG. 16 taken along the line XVII—XVII.

A fifth embodiment is shown in FIGS. 15–17. A mud applicator 211 comprises a generally rectangular shaped box 212 formed by a back wall 213, a top wall 215, a bottom wall 217, two parallel side walls 219, and a front wall 221. Top wall 215 is parallel to bottom wall 217 and perpendicular to side walls 219. Front wall 221 is skewed approximately ten degrees relative to back wall 213, as shown in FIG. 17. A generally inverted trapezoidal mud exit or slot 222 is located in front wall 221 where it interfaces top wall 215. Mud slot 222 extends transversely between side walls 219 but does not intersect them.

Mud applicator 211 has a hollow tubular handle 223 that is fastened to box 212 with a pair of brackets. A handle flange 225 extends from an upper end of handle 223 to top wall 215 and a support bracket 227 extends between handle 223 and back wall 213. A pump (not shown) provides a continuous source of drywall mud to applicator 211 through a mud hose 231. Mud hose 231 is divided into two secondary hoses 233, each of which extends through a hole 235 in handle 223. Secondary hoses 233 feed directly into box 212.

Box 212 comprises an upper hollow chamber 241 and a lower solid portion 243, both of which are generally rectangular. A mud control valve 245 is located in solid portion 243 for controlling the flow of mud. Valve 245 is parallel to top wall 215 and bottom wall 217. Valve 245 comprises a cylindrical valve core 249 that is rotatably mounted within a transverse bore 247. Core 249 has a longitudinal valve opening 251 which is registerable with a cavity 253 in solid portion 243. When core 249 is rotated to an open position, opening 251 aligns with cavity 253 for releasing mud into chamber 241. When core 249 is rotated to a closed position, opening 251 does not align with cavity 253 so that mud is not released into chamber 241. Core 249 has a pair of holes 255 into which mud is fed from secondary hoses 223. Core 249 is sealed in bore 247 with an o-ring 257 on each end.

A solid cylindrical hub 261 extends from each end of core 249 beyond side walls 219. Hubs 261 rotate with core 249. Each hub 261 has a diametrical bore 263 which extends diagonally through it. A wheel leg 265 comprising a rod extends rigidly through each bore 263 past front wall 221. Legs 265 are fixed from movement relative to hubs 261. A small wheel 267 is located on a lower end of each leg 265. A tension spring 269 is attached to an upper end of each leg 265 and the adjacent side wall 219. Spring 269 biases wheels 267 to an extended position away from box 212. The wheel assembly on each side of box 212 gives it a symmetrical appearance. When wheels 267 are in the extended position, spring 269 is in a collapsed position and valve 245 is closed. When wheels 267 are in a depressed position, closer to box 212, spring 269 is stretched and valve 245 is open.

Applicator 211 has a wipedown blade assembly 271 mounted on top of top wall 215 for adjusting the thickness of the layer of mud screeded on a wall. Wipedown blade assembly 271 comprises a wipedown blade 273 which is mounted within a blade holder 275. Blade 273 extends beyond a forward edge of top wall 215 where it interfaces with forward wall 221. Blade 273 and blade holder 275 are moveable in forward and rearward directions parallel to top wall 215. A set of blade holder clamps 277 are located on a rear side of blade holder 275. Clamps 277 interface with a blade adjuster cam 279 which is provided for moving blade 273. A pair of skid shoes 280 are provided along the upper interfaces of forward wall 221 and side walls 219 for providing protection against wear to box 212.

Applicator 211 also comprises a pair of corner pin assemblies 281. Corner pin assemblies 281 are mounted to upper ends of side walls 219. Each corner pin assembly 281 comprises a U-shaped bracket 283 and an L-shaped pin 285 which is slidably mounted therein. Bracket 283 and pin 285 are mounted on side walls 219 parallel to top wall 215. When a pin 285 is pushed forward, applicator 211 may be run down the edge of a wall with the pin extending past the edge so that a more uniform corner bead is screeded.

Finally, an adjustment screw assembly 291 is provided for controlling the amount of mud flow admitted by control valve 245. Adjustment screw assembly 291 is located in a lower corner of solid portion 243 behind one of wheels 267. Assembly 291 allows a worker to adjust the flow of mud to a comfortable working speed.

In operation, applicator 211 is used by placing blade 273 against a wall so that handle 223 extends diagonally away from the wall. Without moving blade 273 relative to the wall, handle 223 is rotated downward until wheels 267 make contact with the wall. As wheels 267 are moved to the collapsed position, valve 245 opens and fills chamber 241 with mud which flows through mud slot 222. The amount of mud flow may be adjusted with adjustment screw assembly 291 at any time. With wheels 267 in the collapsed position, applicator 211 is moved in a stroking motion to apply mud onto the wall. Mud will continue to flow as long as wheels 267 remain in the collapsed position. A free standing wall corner may be screeded by extending one of pins 285 in corner pin assemblies 281.

The present invention provides easier and more efficient application of mud than the prior art. First, the screed allows the user to apply the mud, smooth it, and wipe away any excess all in one motion of the applicator. Second, a continuous source of mud to the applicator tool provides significant advantages. For example, the user can continuously apply mud from a vat feeding the pump as opposed to repeatedly refilling a smaller container that is kept next to the drywall to which the mud is being applied. Also, the continuous supply of mud through the applicator results in a lightweight applicator since mud does not have to be stored in the applicator. Finally, applying mud with the present invention is more convenient because of certain aspects of the different embodiments such as adjustable length handles and adjustable width mud exits. Also, the specific embodiments for drywall sections of right angle corners, columns, and doorways make these traditionally difficult jobs far more manageable.

While the invention has been shown in only some of its forms, it should be apparent to those skilled in the art that it is not so limited but is susceptible to various changes without departing from the scope of the invention. For example, the control valve on any of these embodiments can be mounted on either the handle of the applicator tool or the mud hose feeding mud to the applicator. Also, the variable length handle can be incorporated into the handles of any of these embodiments.

I claim:

1. An applicator for dispensing wallboard compound, comprising:

a tubular handle having an axis and an axial flow passage;

an applicator head secured to one end of the handle, the head having a wall-contacting face, two opposite side edges spaced apart greater than a diameter of the handle, and a compound chamber in communication with the flow passage;

a compound hose attached to the head for supplying compound to the compound chamber;

a flow terminator mounted in the applicator for controlling the flow of compound from the compound hose;

a compound outlet in the wall-contacting face for dispensing compound onto a wall; and a wipedown screed located on the head adjacent to the compound outlet for screeding compound on the wall, the screed extending forward, past and generally perpendicular to the face, wherein the head is at an angle of at least thirty degrees relative to the handle.

2. The applicator of claim 1 wherein the flow terminator is a control valve.

3. The applicator of claim 2, further comprising a control valve mounted in the applicator for controlling the flow of compound from the compound hose, the control valve having a cylindrical core located within a bore in the head, the core and the bore each having a slot and being rotatable relative to one another, the slots being alignable with each other to release compound into the compound chamber, and the slots being misalignable with each other to prevent compound from being released into the compound chamber.

4. The applicator of claim 1, further comprising a shoe slide located on each of the side edges of the head adjacent to the screed for preventing wear to the head.

5. The applicator of claim 1, further comprising a guide member located along each of the side edges of the head, each of the guide members being moveable from a retracted position wherein it does not protrude forward of the face to an extended position protruding forward of the face.

6. The applicator of claim 1, further comprising means for selectively varying a cross-sectional area of the compound outlet.

7. An applicator for dispensing wallboard compound, comprising:

a handle;

an applicator head secured to one end of the handle, the head having a wall-contacting face, two opposite side edges and a compound chamber;

a compound hose attached to the head for supplying compound to the compound chamber;

a control valve mounted in the applicator for controlling the flow of compound from the compound hose;

a compound outlet in the wall-contacting face for dispensing compound onto a wall, the compound outlet having a plurality of baffles which define a plurality of passages; and a wipedown screed located on the head adjacent to the compound outlet for screeding compound on the wall, the screed extending past and generally perpendicular to the face.

8. The applicator of claim 7, wherein the handle comprises a telescoping hollow shaft.

9. An applicator for dispensing wallboard compound, comprising:

a handle;

applicator head secured to one end of the handle, the head having a wall-contacting face, two opposite side edges and a compound chamber;

a compound hose attached to the head for supplying compound to the compound chamber;

a control valve mounted in the applicator for controlling the flow of compound from the compound hose;

a guide member located along each of the side edges of the head, each of the guide members being moveable from a retracted position wherein it does not protrude forward of the face to an extended position protruding forward of the face;

a compound outlet in the wall-contacting face for dispensing compound onto a wall; and a wipedown screed located on an upper surface of the head adjacent to the compound outlet for screeding compound on the wall, the screed extending forward from and generally perpendicular to the face.

10. The applicator of claim 9, wherein the handle comprises a telescoping shaft.

11. The applicator of claim 9, further comprising means for varying a width of the compound outlet.

12. The applicator of claim 9, further comprising a plunger which is located in the head next to the compound outlet, the plunger being laterally moveable relative to the outlet to vary a width of the outlet.

13. An applicator for dispensing wallboard compound, comprising:

a handle;

an applicator head secured to one end of the handle, the head having a longitudinal axis, a wall-contacting face, first and second opposite side walls, the face and the side walls defining a compound chamber which extends laterally across the head;

a compound hose attached to the head for supplying compound to the compound chamber;

a control valve mounted in the applicator for controlling the flow of compound from the compound hose;

a laterally-extending compound outlet in the wall-contacting face for dispensing compound from the compound chamber onto a wall;

a plunger carried in the compound chamber in sliding contact with the face for lateral movement relative to the head, wherein moving the plunger from the first side wall toward the second side wall effectively reduces a width of the outlet.

14. The applicator of claim 13, further comprising a wipedown screed located on the head adjacent to the compound outlet for screeding compound on the wall, the screed extending forward from and generally perpendicular to the face.

15. The applicator of claim 13, further comprising a guide member located along each of the side walls of the head, each of the guide members being moveable from a retracted position wherein it does not protrude forward of the face to an extended position protruding forward of the face.

16. An applicator for dispensing wallboard compound, comprising:

a handle;

a corner applicator head secured to one end of the handle, the head having a wedge-shaped, wall corner-contacting face and a compound chamber;

a compound hose attached to the head for supplying compound to the compound chamber;

a flow terminator mounted in the applicator for controlling the flow of compound from the compound hose; and a plurality of compound outlet holes in the wall-contacting face for dispensing compound onto a wall.

17. The applicator of claim 16, further comprising a V-shaped wipedown screed located on an upper surface of the head for screeding compound on the wall, the screed extending forward from and generally perpendicular to the face.

18. The applicator of claim 16, further comprising a ball and socket joint which secures the handle to the head, allowing swiveling movement of the head relative to the handle.

19. An applicator for dispensing wallboard compound, comprising:

a tubular handle;

an applicator head secured to one end of the handle, the head having a wall-contacting face, two opposite side walls and a compound chamber;

a compound hose attached to the head for supplying compound to the compound chamber;

control valve mounted in the applicator for controlling the flow of compound from the compound hose, the control valve having a cylindrical core located within a bore in the head, the core and the bore each having a slot and being rotatable relative to one another, the slots being alignable with each other to release compound into the compound chamber, and the slots being misalignable with each other to prevent compound from being released into the compound chamber; and a compound outlet in the wall-contacting face for dispensing compound onto a wall.

20. The applicator of claim 19 wherein the core rotates relative to the body.

21. The applicator of claim 19, further comprising a wipedown screed located on an upper surface of the head adjacent to the compound outlet for screeding compound on the wall, the screed extending forward from and generally perpendicular to the face.

22. The applicator of claim 19, further comprising a guide member located along each of the side walls, each of the guide members being moveable from a retracted position wherein it does not protrude forward of the face to an extended position protruding forward of the face.

23. The applicator of claim 19, further comprising;

a pair of arms pivotally mounted to the head;

a wheel on one end of each of the arms for contacting a wall surface; and wherein each of the arms is connected to the core for rotating the slots into alignment when the arms are in a retracted position.

* * * * *